US007483830B2

(12) United States Patent
Rotola-Pukkila et al.

(10) Patent No.: US 7,483,830 B2
(45) Date of Patent: Jan. 27, 2009

(54) SPEECH DECODER AND A METHOD FOR DECODING SPEECH

(75) Inventors: Jani Rotola-Pukkila, Tampere (FI); Janne Vainio, Lempäälä (FI); Hannu Mikkola, Tampere (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 09/797,115

(22) Filed: Mar. 1, 2001

(65) Prior Publication Data

US 2001/0027390 A1 Oct. 4, 2001

(30) Foreign Application Priority Data

Mar. 7, 2000 (FI) ..... 20000524

(51) Int. Cl.
*G10L 19/04* (2006.01)

(52) U.S. Cl. ..... 704/219; 704/220; 704/216

(58) Field of Classification Search ..... 704/216–223, 704/500, 203, 268, 214, 264, 250, 228; 375/285, 375/295, 208
See application file for complete search history.

(56) References Cited

U.S. PATENT DOCUMENTS

| | | | | |
|---|---|---|---|---|
| 5,455,888 | A | 10/1995 | Iyengar et al. | |
| 5,581,652 | A | 12/1996 | Abe et al. | |
| 5,978,759 | A * | 11/1999 | Tsushima et al. | 704/223 |
| 6,539,355 | B1 * | 3/2003 | Omori et al. | 704/268 |
| 6,675,144 | B1 * | 1/2004 | Tucker et al. | 704/264 |
| 6,681,202 | B1 * | 1/2004 | Miet et al. | 704/214 |
| 6,732,075 | B1 * | 5/2004 | Omori et al. | 704/250 |

FOREIGN PATENT DOCUMENTS

| | | |
|---|---|---|
| EP | 0658874 A1 | 6/1995 |
| EP | WO 98/52187 | 11/1998 |
| EP | WO 98/57436 | 12/1998 |
| JP | 6 85607 | 12/1994 |
| JP | 8 76798 | 3/1996 |
| JP | 8 76799 | 3/1996 |
| JP | 8 123495 | 5/1996 |
| JP | 9 90992 | 4/1997 |
| JP | 2001 565171 | 8/2001 |
| WO | WO 99/49454 | 9/1999 |

OTHER PUBLICATIONS

Japanese Patent document No. 10-124089.

* cited by examiner

*Primary Examiner*—Huyen X. Vo
(74) *Attorney, Agent, or Firm*—Perman & Green, LLP

(57) ABSTRACT

A speech decoder comprises a decoder (103) for converting a linear prediction encoded speech signal into a first sample stream having a first sampling rate and representing a first frequency band. Additionally it comprises a vocoder (105) for converting an input signal into a second sample stream having a second sampling rate and representing a second frequency band, and combination means (107) for combining the first and second sample streams in processed form. It comprises also means (301) for generating a second linear prediction filter, to be used by the vocoder (105) on the second frequency band, on the basis of a first linear prediction filter used by the decoder (103) on the first frequency band. Extrapolation through an infinite impulse response filter is the preferable method of generating the second linear prediction filter.

26 Claims, 4 Drawing Sheets

SPEECH DECODER AND A METHOD FOR DECODING SPEECH

TECHNOLOGICAL FIELD

The invention concerns in general the technology of decoding digitally encoded speech. Especially the invention concerns the technology of generating a wide frequency band decoded output signal from a narrow frequency band encoded input signal.

BACKGROUND OF THE INVENTION

Digital telephone systems have traditionally relied on standardized speech encoding and decoding procedures with fixed sampling rates in order to ensure compatibility between arbitrarily selected transmitter-receiver pairs. The evolution of second generation digital cellular networks and their functionally enhanced terminals has resulted in a situation where full one-to-one compatibility regarding sampling rates can not be guaranteed, i.e. the speech encoder in the transmitting terminal may use an input sampling rate which is different than the output sampling rate of the speech decoder in the terminal. Also the linear prediction or LP analysis of the original speech signal may be performed on a signal that has a narrower frequency band than the actual input signal because of complexity restrictions. The speech decoder of an advanced receiving terminal must be able to generate an LP filter with a wider frequency band than that used in the analysis, and to produce a wideband output signal from narrowband input parameters. The generation of a wideband LP filter from existing narrowband information has also wider applicability.

FIG. 1 illustrates a known principle for converting a narrowband encoded speech signal into a wideband decoded sample stream that can be used in speech synthesis with a high sampling rate. In the transmitting end an original speech signal has been subjected to low-pass filtering (LPF) in block 101. The resulting signal on a low frequency sub-band has been encoded in a narrowband encoder 102. In the receiving end the encoded signal is fed into a narrowband decoder 103, the output of which is a sample stream representing the low frequency sub-band with a relatively low sampling rate. In order to increase the sampling rate the signal is taken into a sampling rate interpolator 104.

The higher frequencies that are missing from the signal are estimated by taking the LP filter (not separately shown) from block 103 and using it to implement an LP filter as a part of a vocoder 105 which uses a white noise signal as its input. In other words, the frequency response curve of the LP filter in the low frequency sub-band is stretched in the direction of the frequency axis to cover a wider frequency band in the generation of a synthetically produced high frequency sub-band. The power of the white noise is adjusted so that the power of the vocoder output is appropriate. The output of the vocoder 105 is high-pass filtered (HPF) in block 106 in order to prevent excessive overlapping with the actual speech signal on the low frequency sub-band. The low and high frequency sub-bands are combined in the summing block 107 and the combination is taken to a speech synthesizer (not shown) for generating the final acoustic output signal.

We may consider an exemplary situation where the original sampling rate of the speech signal was 12.8 kHz and the sampling rate at the output of the decoder should be 16 kHz. The LP analysis has been performed for frequencies from 0 to 6400 Hz, i.e. from zero to the Nyquist frequency which is one half of the original sampling rate. Consequently the narrowband decoder 103 implements an LP filter the frequency response of which spans from 0 to 6400 Hz. In order to generate the high frequency sub-band, the frequency response of the LP filter is stretched in the vocoder 105 to cover a frequency band from 0 to 8000 Hz, where the upper limit is now the Nyquist frequency regarding the desired higher sampling rate.

A certain degree of overlap is usually desirable, although not necessary, between the low and high frequency sub-bands; the overlap may help to achieve optimal subjective audio quality. Let us assume that an overlap of 10% (i.e. 800 Hz) is aimed at. This means that in the narrowband decoder 103 the whole frequency response of 0 to 6400 Hz (i.e. $0\text{-}0.5F_s$ with the sampling rate $F_s$=12.8 kHz) of the LP filter is used, and in the vocoder 105 effectively only the frequency response of 5600 to 8000 Hz (i.e. $0.35F_s$–$0.5F_s$ with the sampling rate $F_s$=16 kHz) of the LP filter is used. Here "effectively" means that because of the high pass filter 106, the lower end of the frequency response does not have an effect on the output of the upper signal processing branch. The frequency response of the wideband LP filter in the range of 5600 to 8000 Hz is a stretched copy of the frequency response of the narrowband LP filter in the range of 4480 to 6400 Hz.

The drawbacks of the prior art arrangement become noticeable in a situation where the frequency response of the narrowband LP filter has a peak in its upper region, close to the original Nyquist frequency. FIG. 2 illustrates such a situation. The thin curve 201 represents the frequency response of a 0 to 8000 Hz LP filter which would be used in the analysis of a speech signal with a sampling rate 16 kHz. The thick curve 202 represents the combined frequency response that the arrangement of FIG. 1 would produce. The dashed lines 203 and 204 at 4480 Hz and 6400 Hz respectively delimit the portion of the frequency response of a narrowband LP filter that gets copied and stretched into the 5600 Hz to 8000 Hz interval in the wideband LP filter implemented in the vocoder. A peak at approximately 4400 Hz in the narrowband frequency response and the continuous downhill therefrom towards the upper limit of the frequency band cause the combined frequency response curve 202 to differ remarkably of the frequency response 201 of an ideal wideband LP filter.

Various prior art arrangements are known for complementing the principle of FIG. 1 to overcome the above-presented drawback. The patent publication U.S. Pat. No. 5,978,759 discloses an apparatus for expanding narrowband speech to wideband speech by using a codebook or look-up table. A set of parameters characteristic to the narrowband LP filter are extracted and taken as a search key to a look-up table so that the characteristic parameters of the corresponding wideband LP filter can be read from a matching or nearly matching entry in the look-up table. A similar solution is known from the patent publication number JP 10124089A. A slightly different approach is known from the patent publication number U.S. Pat. No. 5,455,888, where the higher frequencies are generated by using a filter bank which, however, is selected by using a kind of look-up table. The patent publication number U.S. Pat. No. 5,581,652 proposes the reconstruction of wideband speech from narrowband speech by using codebooks so that the waveform nature of the signals is exploited. Further in the published international patent application number WO 99/49454A1 there is disclosed a method where a speech signal is transformed into frequency domain, the characteristic peaks of the frequency domain signal are identified and a set of wideband filter parameters are selected on the basis of a conversion table.

The use of a look-up table in searching for the characteristics of a suitable wideband filter may help to avoid disasters of the kind shown in FIG. 2, but simultaneously it involves a considerable degree of inflexibility. Either only a limited number of possible wideband filters may be implemented or a very large memory must be allocated solely for this purpose. Increasing the number of stored wideband filter configurations to choose from also increases the time that must be allocated for searching for and setting up the right one of them, which is not desirable in real time operation like speech telephony.

SUMMARY OF THE INVENTION

It is an object of the present invention to present a speech decoder and a method for decoding speech where the expansion of a frequency band is made in a flexible way which is computationally economical and imitates well the characteristics that would be obtained by originally using a wider bandwidth.

The objects of the invention are achieved by generating a wideband LP filter from a narrowband one so that extrapolation on the basis of certain regularities in the narrowband LP filter poles is utilized.

According to the invention a speech processing device comprises

- an input for receiving a linear prediction encoded speech signal representing a first frequency band,
- means for extracting, from the linear prediction encoded speech signal, information describing a first linear prediction filter associated with the first frequency band and
- a vocoder for converting an input signal into an output signal representing a second frequency band;

it is characterized in that it comprises

- means for generating a second linear prediction filter, to be used by the vocoder on the second frequency band, on the basis of the information describing the first linear prediction filter.

The invention applies also to a digital radio telephone which is characterized in that it comprises at least one speech processing device of the above-mentioned kind.

Additionally the invention applies to a speech decoding method which comprises the steps of:

- extracting, from a linear prediction encoded speech signal, information describing a first linear prediction filter associated with a first frequency band and
- converting an input signal into an output signal representing a second frequency band;

it is characterized in that it comprises the step of:

- generating a second linear prediction filter, to be used in the conversion of the input signal to the output signal on the basis of the extracted information describing a first linear prediction filter associated with a first frequency band.

Several well-known forms of presentation exist for LP filters. Especially there is known a so-called frequency domain representation, where an LP filter can be represented with an LSF (Line Spectral Frequency) vector or an ISF (Immettance Spectral Frequency) vector. The frequency domain representation has the advantage of being independent of sampling rate.

According to the invention a narrowband LP filter is dynamically used as a basis for constructing a wideband LP filter by means of extrapolation. Especially the invention involves converting the narrowband LP filter into its frequency domain representation, and forming a frequency domain representation of a wideband LP filter by extrapolating that of the narrowband LP filter. An IIR (Infinite Impulse Response) filter of a high enough order is preferably used for the extrapolation in order to take advantage of the regularities characteristic to the narrowband LP filter. The order of the wideband LP filter is preferably selected so that the ratio of the wideband and narrowband LP filter orders is essentially equal to the ratio of the wideband and narrowband sampling frequencies. A certain set of coefficients are needed for the IIR filter; these are preferably obtained by analyzing the autocorrelation of a difference vector which reflects the differences between adjacent elements in the narrowband LP filter's vector representation.

In order to ensure that the wideband LP filter does not give rise to excessive amplification close to the Nyquist frequency, it is advantageous to place certain limitations to the last element(s) of the wideband LP filter's vector representation. Especially the difference between the last element in the vector representation and the Nyquist frequency, proportioned to the sampling frequency, should stay approximately the same. These limitations are easily defined through differential definitions so that the difference between adjacent elements in the vector representation is controlled.

BRIEF DESCRIPTION OF DRAWINGS

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

FIGS. 1 and 2 have been described within the description of prior art, so the following description of the invention and its advantageous embodiments concentrates on FIGS. 3*a* to 6. Same reference designators are used for similar parts in the drawings.

DETAILED DESCRIPTION OF THE INVENTION

Figure 3A:
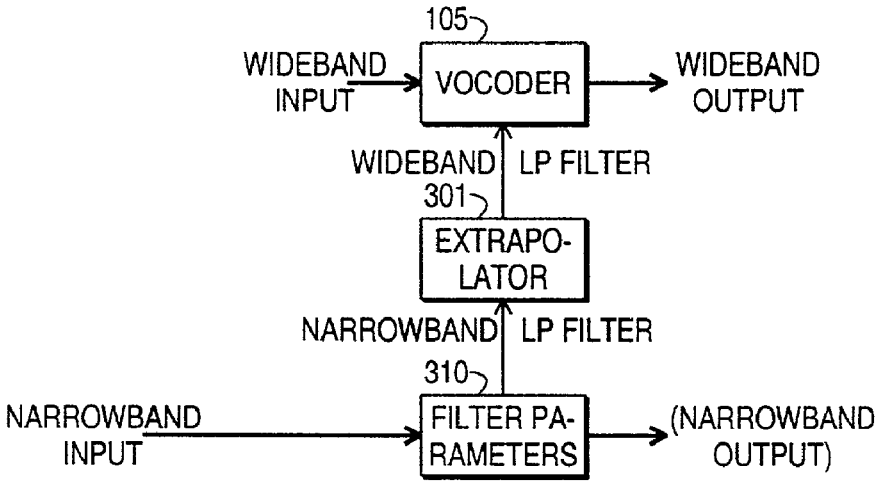
FIG. 3*a* illustrates the principle of the invention.

FIG. 3*a* illustrates the use of a narrowband input signal to extract the parameters of a narrowband LP filter in an extracting block 310. The narrowband LP filter parameters are taken into an extrapolation block 301 where extrapolation is used to produce the parameters of a corresponding wideband LP filter. These are taken into a vocoder 105 which uses some wideband signal as its input. The vocoder 105 generates a wideband LP filter from the parameters and uses them to convert the wideband input signal into a wideband output signal. Also the extracting block 310 may give an output, which is a narrowband output.

Figure 1:
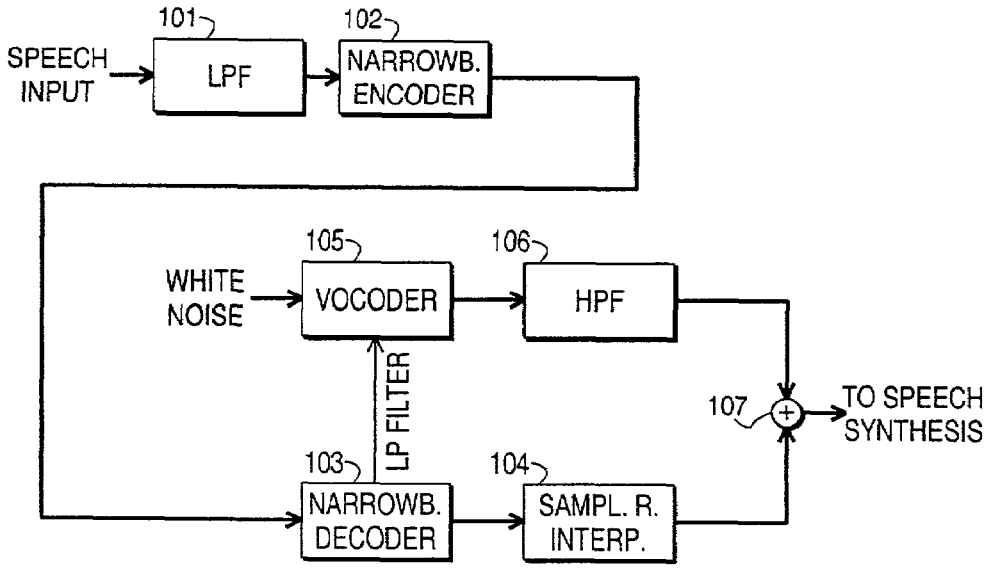
Fig. 1 PRIOR ART
FIG. 1 illustrates a known speech decoder.
Figure 3B:
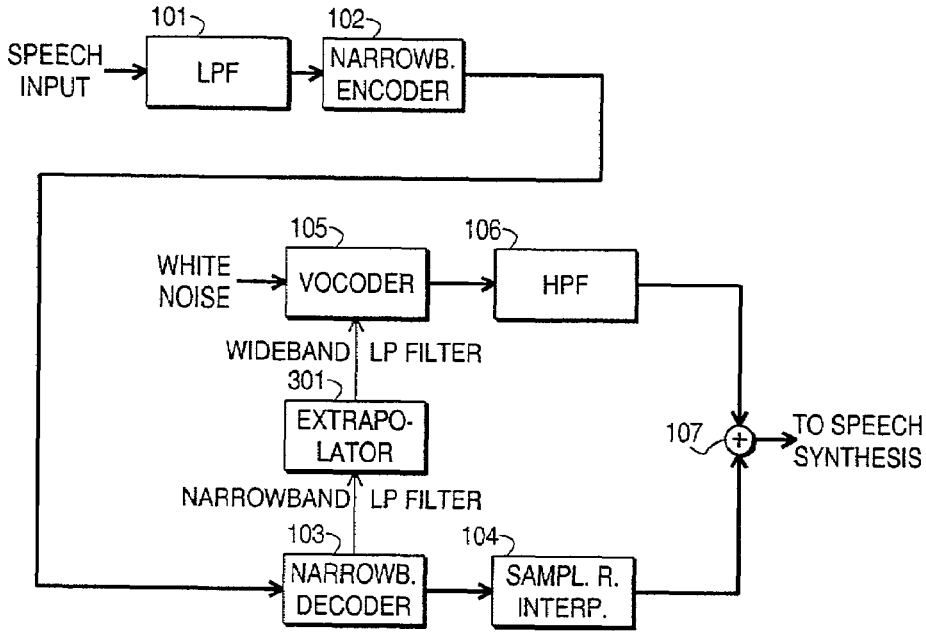
FIG. 3*b* illustrates the application of the principle of FIG. 3*a* into a speech decoder.

FIG. 3*b* shows how the principle of FIG. 3*a* can be applied to an otherwise known speech decoder. A comparison between FIG. 1 and FIG. 3*b* shows the addition brought through the invention into the otherwise known principle for converting a narrowband encoded speech signal into a wideband decoded sample stream. The invention does not have an effect on the transmitting end: the original speech signal is low-pass filtered in block 101 and the resulting signal on a low frequency sub-band in encoded in a narrowband encoder 102. Also the lower branch in the receiving end may well be the same: the encoded signal is fed into a narrowband decoder 103, and in order to increase the sampling rate of the low frequency sub-band output thereof the signal is taken into a sampling rate interpolator 104. However, the narrowband LP filter used in block 103 is not taken directly into the vocoder 105 but into an extrapolation block 301 where a wideband LP filter is generated.

The frequency response curve of the LP filter in the low frequency sub-band is not simply stretched to cover a wider frequency band; nor are the narrowband LP filter characteristics used as a search key to any library of previously generated wideband LP filters. The extrapolation which is performed in block 301 means generating a unique wideband LP filter and not just selecting the closest match from a set of alternatives. It is a truly adaptive method in the sense that by selecting a suitable extrapolation algorithm it is possible to ensure a unique relationship between each narrowband LP filter input and the corresponding wideband LP filter output. The extrapolation method works even when little is known beforehand about the narrowband LP filters that will be encountered as input information. This is a clear advantage over all solutions based on look-up tables, since such tables can only be constructed when it is more or less known, into which categories the narrowband LP filters will fall. Additionally, the extrapolation method according to the invention requires only a limited amount of memory, because only the algorithm itself needs to be stored.

The use of the wideband LP filter obtained from block 301 in the generation of a synthetically produced high frequency sub-band may follow the pattern known as such from prior art. White noise is fed as input data into the vocoder 105 which uses the wideband LP filter in producing a sample stream representing the high frequency sub-band. The power of the white noise is adjusted so that the power of the vocoder output is appropriate. The output of the vocoder 105 is high-pass filtered in block 106 and the low and high frequency sub-bands are combined in the summing block 107. The combination is ready to be taken to a speech synthesizer (not shown) for generating the final acoustic output signal.

Figure 4:
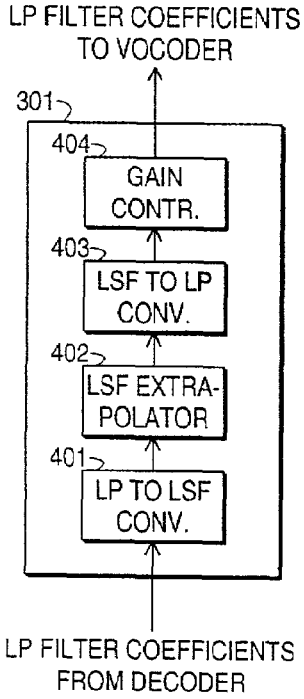
FIG. 4 shows a detail of the arrangement of FIG. 3*b*.

FIG. 4 illustrates an exemplary way of implementing the extrapolation block 301. An LP to LSF conversion block 401 converts the narrowband LP filter obtained from the decoder 103 into frequency domain. The actual extrapolation is done in the frequency domain by an extrapolator block 402. The output thereof is coupled to an LSF to LP conversion block 403 which performs a reverse conversion compared to that made in block 401. Additionally there is, coupled between the output of block 403 and a control input of the vocoder 105, a gain controller block 404 the task of which is to scale the gain of the wideband LP filter to an appropriate level.

Figure 5:
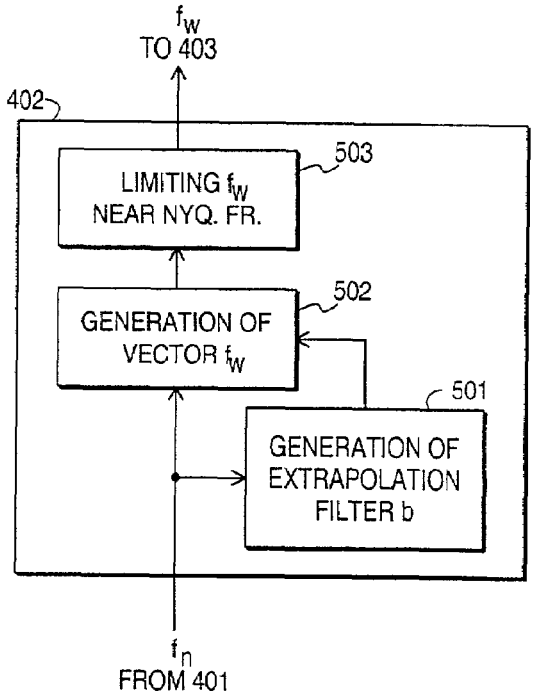
FIG. 5 shows a detail of the arrangement of FIG. 4.

FIG. 5 illustrates an exemplary way of implementing the extrapolator 402. The input thereof is coupled to the output of the LP to LSF conversion block 401, so a vector representation $f_n$ of the narrowband LP filter is obtained as an input to the extrapolator 402. In order to perform the extrapolation, an extrapolation filter is generated by analyzing the vector $f_n$ in a filter generator block 501. The filter may also be described with a vector, which here is denoted as the vector b. By using the filter generated in block 501, the vector representation $f_n$ of the narrowband LP filter is converted to a vector representation $f_w$ of the wideband LP filter in block 502. Finally, in order to ensure that the wideband LP filter does not include excessive amplification near the Nyquist frequency regarding the higher sampling rate, the vector representation $f_w$ of the wideband LP filter is subjected to certain limiting functions in block 503 before passing it on to the LSF to LP conversion block 403.

We will now provide a detailed analysis of the operations performed in the various functional blocks introduced above in FIGS. 4 and 5. It is taken as a fact that the decoder 103 implements and utilizes an LP filter in the course of decoding the narrowband speech signal. This LP filter is designated as the narrowband LP filter, and it is characterized through a set of LP filter coefficients. It is likewise a fact that practically all high quality speech decoders (and encoders) use certain vectors known as LSF or ISF vectors to quantize the LP filter coefficients, so functionally the LP to LSF conversion shown as block 401 in FIG. 4 can even be a part of the decoder 103. Throughout this description we speak about LSF vectors for the sake of consistency, but it is straightforward to a person skilled in the art to apply the description also to the use of ISF vectors.

LSF vectors can be represented in either cosine domain, where the vector is actually called the LSP (Line Spectral Pair) vector, or in frequency domain. The cosine domain representation (the LSP vector) is dependent of the sampling rate but the frequency domain representation is not, so if e.g. the decoder 103 is some kind of a stock speech decoder which only offers an LSP vector as input information to the extrapolation block 301, it is preferable to convert the LSP vector first into an LSF vector. The conversion is easily made according to the known formula $$f_n(i) = \arccos(q_n(i))\frac{F_{s,n}}{\pi},\ i = 0,\ \ldots,\ n_n - 1, \tag{1}$$

where the subscript n generally denotes "narrowband", $f_n(i)$ is the i:th element of the narrowband LSF vector, $q_n(i)$ is the i:th element of the narrowband LSP vector, $F_{s,n}$ is the narrowband sampling rate and $n_n$ is the order of the narrowband LP filter. Following the definition of LSP and LSF vectors, $n_n$ is also the number of elements in the narrowband LSP and LSF vectors.

In the embodiment shown in FIGS. 3*b*, 4 and 5, the actual extrapolation takes place in block 502 by using an L:th order extrapolation filter generated in block 501. For the moment we just assume that block 501 provides block 502 with a filter vector b; we will return to the generation of the filter vector later. An advantageous formula for generating the wideband LSF vector $f_w$ is $$f_w(i) = \begin{cases} \sum_{k=i-L}^{i-1} b((i-1)-k) f_w(k),\ i = n_n,\ \ldots,\ n_w - 1 \\ f_n(i),\ i = 0,\ \ldots,\ n_n - 1 \end{cases}, \tag{2}$$

where the subscript w generally denotes "wideband", $f_w(i)$ is the i:th element of the wideband LSF vector, k is a summing index, L is the order of the extrapolation filter and b((i−1)−k) is the ((i−1)−k):th element of the extrapolation filter vector. In other words, as many elements as there were in the narrowband LSF vector are exactly the same at the beginning of the wideband LSF vector. The rest of the elements in the wideband LSF vector are calculated so that each new element is a weighted sum of the previous L elements in the wideband LSF vector. The weights are the elements of the extrapolation filter vector in a convolutional order so that in calculating $f_w(i)$, the element $f_w(i-L)$ which is the most distant previous element contributing to the sum is weighted with b(L−1) and the element $f_w(i-1)$ which is the closest previous element contributing to the sum is weighted with b(0).

The extrapolation formula (2) does not limit the value of $n_w$, i.e. the order of the wideband LP filter. In order to preserve the accuracy of extrapolation, it is advantageous to select the value of $n_w$ so that $$n_w \approx n_n \frac{F_{s,w}}{F_{s,n}} \tag{3}$$

meaning that the orders of the LP filters are scaled according to the relative magnitudes of the sampling frequencies.

The requirement that the wideband LP filter should not produce excessive amplification on frequencies close to the Nyquist frequency 0.5 $F_{s,w}$ can be formulated with the help of the difference between the last element of each LP filter vector and the corresponding Nyquist frequency, where the difference is further scaled with the sampling frequency, according to the formula $$\frac{0.5F_{s,w} - f_w(n_w - 1)}{F_{s,w}} \geq \frac{0.5F_{s,n} - f_n(n_n - 1)}{F_{s,n}}. \tag{4}$$

The above-given limitations (3) and (4) to the wideband LP filter restrict the selection of $n_w$ and the definition of the extrapolation filter. Exactly how the restrictions are implemented is a matter of routine workshop experimentation. One advantageous approach is to define a difference vector D so that $$D(k)=f_w(k)-f_w(k-1), k=n_n, \ldots, n_w-1 \tag{5}$$

and to limit the difference vector somehow, e.g. by requiring that no element D(k) in the difference vector D may be greater than a predetermined limiting value, or that the sum of the squared elements $(D(k))^2$ of the difference vector D may not be greater than a predetermined limiting value. An LP filter has typically either low- or high-pass filter characteristics, not band-pass or band-stop filter characteristics. The predetermined limiting value can have a relation to this fact in such a way that if the narrowband LP filter has low-pass filter characteristics, the limiting value is increased. If, on the other hand, the narrowband LP filter has high-pass filter characteristics, the limiting value is decreased. Other applicable limitations that refer to the difference vector D are easily devised by a person skilled in the art.

Next we will describe some advantageous ways of generating the filter vector b. The locations of the LP filter poles tend to have some correlation to each other so that the difference vector D the elements of which describe the difference between adjacent LP vector elements comprises certain regularity. We may calculate an autocorrelation function $$AC_D(k) = \sum_{i=k}^{n_n} (D(i) - \mu_D)(D(i-k) - \mu_D), \; k = 1, \ldots, L \tag{6}$$

where $$\mu_D = \sum_{i=1}^{n_n} \frac{D(i)}{n_n} \tag{7}$$

and find its maximum, i.e. the value of the index k which produces the highest degree of autocorrelation. We may denote this value of the index k as m. An advantageous way of defining the filter vector b is then $$b(k) = \begin{cases} 1, & k = 0 \\ 1, & k = m-1 \\ -1, & k = m \\ 0, & k \notin \{0, m-1, m\} \end{cases}. \tag{8}$$

This way the filter vector b follows the regularity of the narrowband LP filter. Even the new elements of the extrapolated wideband LP filter inherit this feature through the use of the filter b in the extrapolation procedure.

It is naturally possible that the autocorrelation function (6) does not have a clear maximum. To take these cases into account we may define that the extrapolation filter vector b must model all regularities in the narrowband LP filter according to their importance. Autocorrelation may be used as a vehicle of such a definition, for example according to the formula $$b(k) = \begin{cases} 1 & , k = 0 \\ \dfrac{AC_D(k-1) - AC_D(k)}{\sum_{i=1}^{L-1} AC_D(i)} & , k = 1, \ldots L-1 \end{cases}. \tag{9}$$

The more general definition (9) converges towards the above-given simpler definition (8) if there is a clear maximum peak in the autocorrelation function.

The LSF vector representation of the wideband LP filter is ready to be converted into an actual wideband LP filter which can be used to process signals that have a sampling rate $F_{s,w}$. For those cases where the LSP vector representation of the wideband LP filter is preferable, an LSF to LSP conversion may be performed according to the formula $$q_w(i) = \cos\left(f_w(i)\frac{\pi}{F_{s,w}}\right), \; i = 0, \ldots, n_w - 1. \tag{10}$$

It should be noted that the cosine domain into which the conversion (10) is performed has the Nyquist frequency at 0.5 $F_{s,w}$, while the cosine domain from which the narrowband conversion (1) was made had the Nyquist frequency 0.5 $F_{s,n}$.

Figure 2:
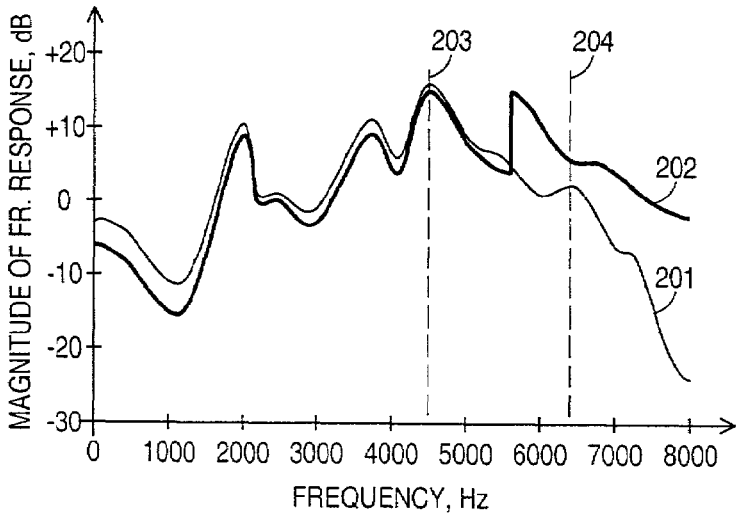
Fig. 2 PRIOR ART
FIG. 2 shows a disadvantageous frequency response of a known wideband LP filter.

The overall gain of the obtained wideband LP filter must be adjusted in a way known as such from the prior art solutions. Adjusting the gain may take place in the extrapolation block 301 as shown as sub-block 404 in FIG. 4, or it may be a part of the vocoder 105. As a difference to the prior art solution of FIG. 1 it may be noted that the overall gain of the wideband LP filter generated according to the invention can be allowed to be larger than that of the prior art wideband LP filter, because large divergences from the ideal frequency response, like that shown in FIG. 2, are not likely to occur and need not to be guarded against.

Figure 6:
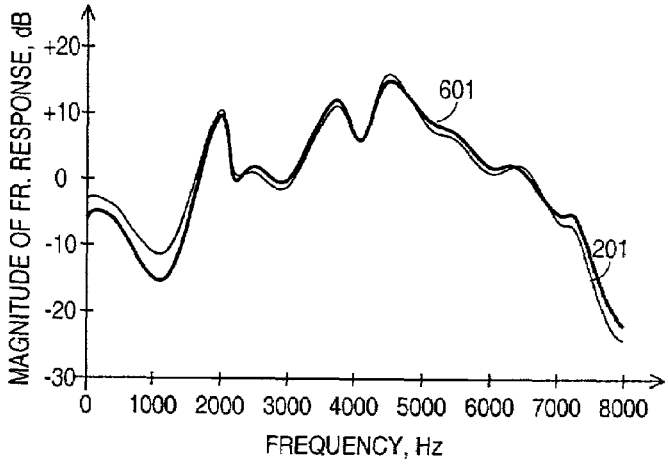
FIG. 6 shows an advantageous frequency response of an LP filter according to the invention.

FIG. 6 illustrates a typical frequency response 601 which could be obtained with a wideband LP filter generated by extrapolating in accordance with the invention. The frequency response 601 follows quite closely the ideal curve 201 which represents the frequency response of a 0 to 8000 Hz LP filter which would be used in the analysis of a speech signal with a sampling rate 16 kHz. The extrapolation approach tends to model the larger scale trends of the amplitude spectrum quite accurately and localize the peaks in the frequency response correctly. A significant advantage of the invention over the prior art arrangement illustrated in FIGS. 1 and 2 is also that the frequency response of the wideband LP filter is continuous, i.e. it does not have any instantaneous changes in magnitude like the one at 5600 Hz in the frequency response of the prior art wideband LP filter.

Figure 7:
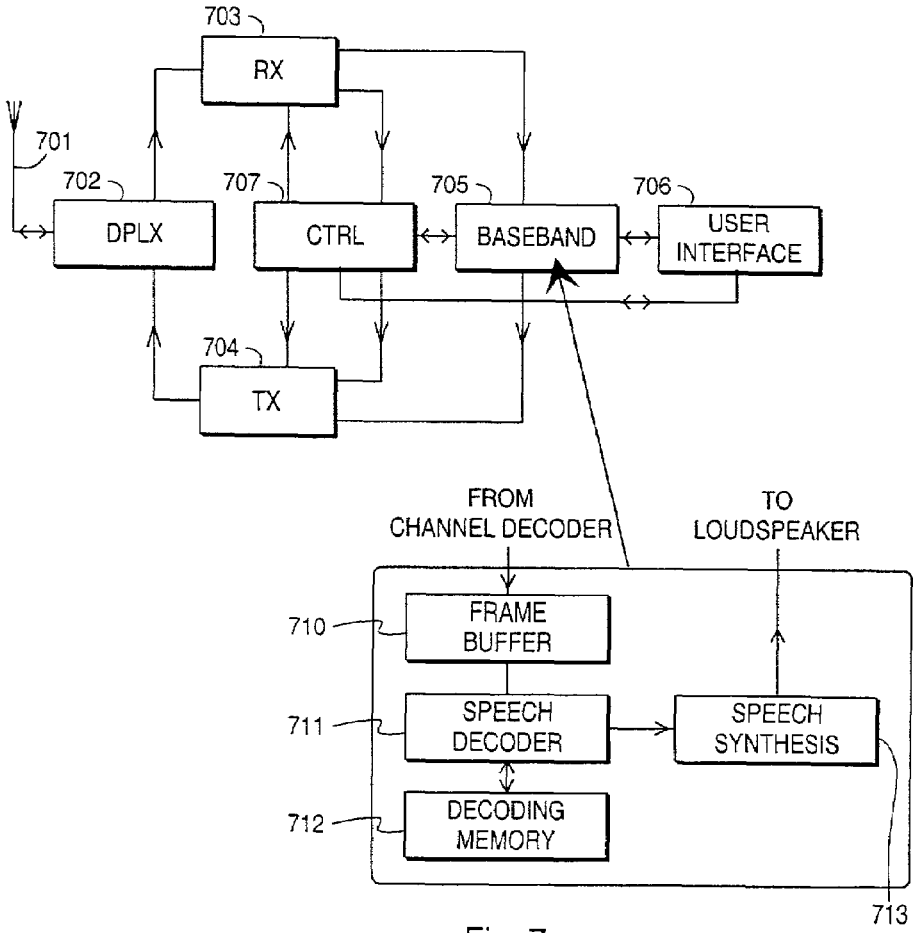
FIG. 7 shows a digital radio telephone with detail in the construction of a baseband block.

A speech decoder alone is not enough for translating the spirit of the invention into advantages conceivable to a human user. FIG. 7 illustrates a digital radio telephone where an antenna 701 is coupled to a duplex filter 702 which in turn is coupled both to a receiving block 703 and a transmitting block 704 for receiving and transmitting digitally coded speech over a radio interface. The receiving block 703 and transmitting block 704 are both coupled to a controller block 707 for conveying received control information and control information to be transmitted respectively. Additionally the receiving block 703 and transmitting block 704 are coupled to a baseband block 705 which comprises the baseband frequency functions for processing received speech and speech to be transmitted respectively. The baseband block 705 and the controller block 707 are coupled to a user interface 706 which typically consists of a microphone, a loudspeaker, a keypad and a display (not specifically shown in FIG. 7).

A part of the baseband block 705 is shown in more detail in FIG. 7. The last part of the receiving block 703 is a channel decoder the output of which consists of channel decoded speech frames that need to be subjected to speech decoding and synthesis. The speech frames obtained from the channel decoder are temporarily stored in a frame buffer 710 and read therefrom to the actual speech decoder 711. The latter implements a speech decoding algorithm read from a memory 712. In accordance with the invention, when the speech decoder 711 finds that the sampling rate of an incoming speech signal should be raised, it employs an LP filter extrapolation method described above to produce the wideband LP filter required in the generation of the synthetically produced high frequency sub-band.

The baseband block 705 is typically a relatively large ASIC (Application Specific Integrated Circuit). The use of the invention helps to reduce the complicatedness and power consumption of the ASIC because only a limited amount of memory and a fractional number of memory accesses are needed for the use of the speech decoder, especially when compared to those prior art solutions where large look-up tables were used to store a variety of precalculated wideband LP filters. The invention does not place excessive requirements to the performance of the ASIC, because the calculations described above are relatively easy to perform.

The invention claimed is:

1. A speech processing device, comprising:

an input for receiving a linear prediction encoded speech signal representing a first frequency band, means for extracting, from the linear prediction encoded speech signal, information in frequency domain describing a first linear prediction filter associated with the first frequency band, means for generating information of regularities between frequency domain filter coefficients of the first linear prediction filter, a vocoder for converting an input signal into an output signal representing a second frequency band, and means for generating a second linear prediction filter, to be used by the vocoder on the second frequency band, by employing an algorithm on the basis of generated information describing said regularities.

2. A speech processing device according to claim 1, comprising:

means for converting the information describing a first linear prediction filter into a first parameter representation in frequency domain, means for extrapolating said first parameter representation into a second parameter representation in frequency domain, and means for converting said second parameter representation into the second linear prediction filter.

3. A speech processing device according to claim 2, wherein said means for extrapolating said first parameter representation into a second parameter representation in frequency domain comprise an infinite impulse response filter.

4. A speech processing device according to claim 3, comprising means for deriving a vector representation of said infinite impulse response filter from said first parameter representation.

5. A speech processing device according to claim 2, comprising means for limiting said second parameter representation.

6. A speech processing device according to claim 1, comprising:

a decoder for converting a linear prediction encoded speech signal into a first sample stream having a first sampling rate and representing a first frequency band, a vocoder for converting an input signal into a second sample stream having a second sampling rate and representing a second frequency band, combination means for combining the first and second sample streams in processed form, and means for generating a second linear prediction filter, to be used by the vocoder on the second frequency band, on the basis of a first linear prediction filter used by the decoder on the first frequency band.

7. A speech processing device according to claim 6, comprising:

a sampling rate interpolator coupled between the decoder and the combination means and a high pass filter coupled between the vocoder and the combination means.

8. A digital radio telephone, comprising:

a speech processing device, within said speech processing device an input for receiving a linear prediction encoded speech signal representing a first frequency band, within said speech processing device means for extracting, from the linear prediction encoded speech signal, information in frequency domain describing a first linear prediction filter associated with the first frequency band, within said speech processing device means for generating information of regularities between frequency domain filter coefficients of the first linear prediction filter, within said speech processing device a vocoder for converting an input signal into an output signal representing a second frequency band, and within said speech processing device, means for generating a second linear prediction filter, to be used by the vocoder on the second frequency band, by employing an algorithm on the basis of generated information describing said regularities.

9. A method, comprising:

extracting, from a linear prediction encoded speech signal, information in frequency domain describing a first linear prediction filter associated with a first frequency band, converting an input signal into an output signal representing a second frequency band, generating information of regularities between frequency domain filter coefficients of the first linear prediction filter and generating a second linear prediction filter, to be used in the conversion of the input signal to the output signal, by employing an algorithm on the basis of the generated information describing said regularities.

10. A method according to claim 9, comprising:

converting a linear prediction encoded speech signal into a first sample stream having a first sampling rate and representing a first frequency band, converting an input signal into a second sample stream having a second sampling rate and representing a second frequency band, combining the first and second sample streams in processed form, and employing the second linear prediction filter with a vocoder on the second frequency band, on the basis of a first linear prediction filter used by the decoder on the first frequency band.

11. A method according to claim 10, comprising:

converting the first linear prediction filter into a first parameter representation in frequency domain, extrapolating said first parameter representation into a second parameter representation in frequency domain, and converting said second parameter representation into the second linear prediction filter.

12. A method according to claim 10, wherein said extrapolating of said first parameter representation into a second parameter representation in frequency domain comprises filtering said first parameter representation with an infinite impulse response filter.

13. A method according to claim 12, comprising calculating a vector representation for said infinite impulse response filter from an observed regularity in said first parameter representation.

14. A method according to claim 13, wherein said extrapolating of said first parameter representation into a second parameter representation in frequency domain comprises determining the values of said second parameter representation as $$f_w(i) = \begin{cases} \sum_{k=i-L}^{i-1} b((i-1)-k) f_w(k), & i = n_n, \ldots, n_w - 1 \\ f_n(i), & i = 0, \ldots, n_n - 1 \end{cases},$$

where $f_w$ (i) is the i:th value of said second parameter representation, k is a summing index, L is the order of said infinite impulse response filter and b ((i−1)-k) is the ((i−1) −k) :th element of the vector representation for said infinite impulse response filter, $f_n$ (i) is the $i^{th}$ element of the first parameter representation, $n_n$ is the number of elements in the first parameter representation, and $n_w$ is the number of elements in the second parameter representation.

15. A method according to claim 14, comprising calculating the vector representation for said infinite impulse response filter so that $$b(k) = \begin{cases} 1, & k = 0 \\ 1, & k = m - 1 \\ -1, & k = m \\ 0, & k \notin \{0, m-1, m\} \end{cases}$$

and m is the value of the index k which produces a maximum value of an autocorrelation function $$AC_D(k) = \sum_{i=k}^{n_n} (D(i) - \mu_D)(D(i-k) - \mu_D), \; k = 1, \ldots, L$$

where $$\mu_D = \sum_{i=1}^{n_n} \frac{D(i)}{n_n},$$

$f_n$(i) is the i:th element of the first parameter representation and $n_n$ is the number of elements in the first parameter representation.

16. A method according to claim 14, comprising calculating the vector representation for said infinite impulse response filter so that $$b(k) = \begin{cases} 1, & k = 0 \\ \dfrac{AC_D(k-1) - AC_D(k)}{\sum_{i=1}^{L-1} AC_D(i)}, & k = 1, \ldots L-1, \end{cases}$$

where $$AC_D(k) = \sum_{i=k}^{n_n} (D(i) - \mu_D)(D(i-k) - \mu_D), \; k = 1, \ldots, L,$$

$$\mu_D = \sum_{i=1}^{n_n} \frac{D(i)}{n_n},$$

$$D(k) = f_n(k) - f_n(k-1), k = 0, \ldots n_n - 1,$$

$f_n$(i) is the i:th element of the first parameter representation and $n_n$ is the number of elements in the first parameter representation.

17. A method according to claim 14, comprising limiting said second vector representation to fulfill the conditions $$n_w \approx n_n \frac{F_{s,w}}{F_{s,n}} \quad \text{and}$$

-continued $$\frac{0.5F_{s,w} - f_w(n_w - 1)}{F_{s,w}} \geq \frac{0.5\,F_{s,n} - f_n(n_n - 1)}{F_{s,n}},$$

where $n_w$ is the number of elements in the second parameter representation, $n_n$ is the number of elements in the first parameter representation, $F_{s,w}$ is the second sampling frequency, $F_{s,n}$ is the first sampling frequency, $f_n(i)$ is the i:th element of the first parameter representation and $f_w(i)$ is the i:th element of the second parameter representation.

18. A speech processing device, comprising:

an input for receiving a linear prediction encoded speech signal representing a first frequency band, means for extracting, from the linear prediction encoded speech signal, information describing a first linear prediction filter associated with the first frequency band, a vocoder for converting an input signal into an output signal representing a second frequency band, means for generating a second linear prediction filter, to be used by the vocoder on the second frequency band, by employing an algorithm on the basis of the information describing the first linear prediction filter, and wherein said generating means extrapolates from a vector representation of the first linear prediction filter, so that said extrapolating involves using vector elements obtained from an autocorrelation of a vector difference among frequency domain coefficients of the first linear prediction filter.

19. A method, comprising:

extracting, from a linear prediction encoded speech signal, information describing a first linear prediction filter associated with a first frequency band, converting an input signal into an output signal representing a second frequency band, and generating a second linear prediction filter, to be used in the conversion of the input signal to the output signal, by employing an algorithm on the basis of the extracted information describing a first linear prediction filter associated with a first frequency band, wherein said generating includes extrapolating from a vector representation of the first linear prediction filter, so that said extrapolating involves using vector elements obtained from an autocorrelation of a vector difference among frequency domain coefficients of the first linear prediction filter.

20. A device, comprising:

an input configured to receive a linear prediction encoded speech signal representing a first frequency band, an extractor configured to extract from the linear prediction encoded speech signal information in frequency domain describing a first linear prediction filter associated with the first frequency band, an information generator configured to generate information of regularities between frequency domain filter coefficients of the first linear prediction filter, a vocoder configured to convert an input signal into an output signal representing a second frequency band, and a filter generator configured to generate a second linear prediction filter, to be used by the vocoder on the second frequency band, by employing an algorithm on the basis of generated information describing said regularities.

21. A device according to claim 20, comprising:

a first converter configured to convert the information describing a first linear prediction filter into a first parameter representation in frequency domain, an extrapolator configured to extrapolate said first parameter representation into a second parameter representation in frequency domain, and a second converter configured to convert said second parameter representation into the second linear prediction filter.

22. A device according to claim 21, wherein said extrapolator comprises an infinite impulse response filter.

23. A device according to claim 22, comprising a vector representation derivator configured to derive a vector representation of said infinite impulse response filter from said first parameter representation.

24. A device according to claim 21, comprising a limiter configured to limit said second parameter representation.

25. A device according to claim 20, comprising:

a decoder configured to convert a linear prediction encoded speech signal into a first sample stream having a first sampling rate and representing a first frequency band, a vocoder configured to convert an input signal into a second sample stream having a second sampling rate and representing a second frequency band, and a combiner configured to combine the first and second sample streams in processed form;

wherein said filter generator is configured to generate said second linear prediction filter, to be used by the vocoder on the second frequency band, on the basis of a first linear prediction filter used by the decoder on the first frequency band.

26. A device according to claim 25, comprising:

a sampling rate interpolator coupled between the decoder and the combiner and a high pass filter coupled between the vocoder and the combiner.

* * * * *